US007517292B2

(12) United States Patent
Harris et al.

(10) Patent No.: US 7,517,292 B2
(45) Date of Patent: Apr. 14, 2009

(54) APPARATUS FOR IMPROVING BODY ROTATION FOR STRIKING A BALL AND METHOD OF USING THE SAME

(76) Inventors: Melvin L. Harris, 1400 North 13th St., Tecumseh, OK (US) 74873; Dana L. Harris, 1400 North 13th St., Tecumseh, OK (US) 74873

( * ) Notice: Subject to any disclaimer, the term of this patent is extended or adjusted under 35 U.S.C. 154(b) by 393 days.

(21) Appl. No.: 11/405,154

(22) Filed: Apr. 17, 2006

(65) Prior Publication Data

US 2007/0243956 A1 Oct. 18, 2007

(51) Int. Cl.
*A63B 69/00* (2006.01)

(52) U.S. Cl. ..... 473/458; 473/22

(58) Field of Classification Search ..... 273/458; 473/205, 207, 232, 422, 425, 450, 458, 451; 434/252; 600/59; 607/17, 19; 128/845
See application file for complete search history.

(56) References Cited

U.S. PATENT DOCUMENTS 3,109,244 A * 11/1963 Trifaro et al. ..... 434/252
5,658,203 A * 8/1997 Shub ..... 473/205
5,685,831 A * 11/1997 Floyd ..... 602/19
6,102,809 A * 8/2000 Nichols ..... 473/227
6,206,787 B1 * 3/2001 Kleppen ..... 473/207
2002/0121742 A1 * 9/2002 Stauber ..... 273/458

* cited by examiner

*Primary Examiner*—Gene Kim
*Assistant Examiner*—M Chambers
(74) *Attorney, Agent, or Firm*—Dunlap Codding, P.C.

(57) ABSTRACT

An apparatus for teaching an individual proper body rotation when striking a ball is disclosed which includes an elongated body member having a first end portion, a medial portion and a second end portion. A strap is connected to the elongated body member for securing the elongated body member in a is substantially horizontally disposed position on a portion of a lower lumbar region of the individual's back whereby at least a portion of the medial portion and the second end portion of the elongated body member extends outwardly from the individual. Upon the individual assuming a ball striking position and simulating a swing or a ball striking motion, at least the second end portion of the elongated body member is caused to cross over a ball striking zone when the individual's hips, lower body and upper body are properly rotated during the swing or ball striking motion. The apparatus may further include a back rest assembly, a rib assembly and a propiteal fossa engaging assembly.

7 Claims, 9 Drawing Sheets

APPARATUS FOR IMPROVING BODY ROTATION FOR STRIKING A BALL AND METHOD OF USING THE SAME

BACKGROUND OF THE INVENTION

1. Field of the Invention

The present invention relates to an exercise, conditioning and flexibility apparatus for strengthening muscles in an individual's legs, abdomen and lower back. In one aspect the present invention relates to an apparatus for improving rotation of an individual's hips, lower body and upper body when simulating striking of a ball. In yet another aspect the present invention relates to an apparatus which facilitates a faster, more completely balanced rotation of an individual's hips, lower body and upper body when striking a ball, such as a baseball, a softball or a golf ball.

2. Brief Description of the Prior Art

Most individuals, when attempting to learn to swing a bat or a golf club have a tendency to swing the bat or golf club with their arms. The method of swinging a bat or golf club using just the arms causes many swing faults that inhibit the individuals ability to hit the ball consistently and with power. For example, when attempting to hit a baseball or softball, the individual's lower and upper body have a tendency to remain square to home plate instead of opening up and finishing at the infield. As a result, the individual loses power through the swing.

Numerous apparatus and methods for enhancing the striking of a ball, whether a baseball, softball or golf ball, have been proposed so that the individual maintains proper rotation of both the upper body and the lower body. However, many of such prior art apparatus and methods fail to ensure that the individual properly turns the lower body and upper body (chest) during the swing motion.

Thus, a need has long existed for an apparatus which can be used as a conditioning and strengthening apparatus, and which simulates a ball striking motion using the hips, lower body and chest. In addition, because of the difference in stature of individuals learning to properly swing a bat or golf club utilizing the apparatus, the apparatus should be adjustable for all size users. It is to such a apparatus and method of use of such apparatus that the present invention is directed.

SUMMARY OF THE INVENTION

The present invention relates to an apparatus for teaching an individual proper body rotation when striking a ball. Broadly, the apparatus includes an elongated body member having a first end portion, a medial portion and a second end portion. A strap is connected to the elongated body member at a position between the first end portion and the medial portion of the elongated body member. A connector assembly is supported on the strap for securing the strap about a waist of an individual such that, upon connection of the apparatus to the individual, the elongated body member of the apparatus is substantially horizontally disposed on a portion of a lower lumbar region of the individual's back whereby at least a portion of the medial portion and the second end portion of the elongated body member extends outwardly from the individual. Thus, upon the individual assuming a ball striking position and simulating a swing or a ball striking motion, at least the second end portion of the elongated body member is caused to cross over a ball striking zone when the individual's hips, lower body and upper body are properly rotated during the swing or ball striking motion.

In one embodiment the apparatus further includes a back rest assembly mounted on an elongated body member. A support member of the back rest assembly is configured so as to be positionable on at least a portion of the lower lumbar region of the individual's back. To stabilize the support member of the back rest assembly and the elongated body member on the individual's back, the back rest assembly is provided with a back rest strap which is connected to the support member or the elongated body member, such that the back rest strap is extendable about the individual's waist when the support member is positioned on at least a portion of the lower lumbar region of the individual's back. Once extended about the individual's waist, the backrest strap is connected so as to secure the back rest strap about the individual's waist and thereby stabilize the support member of the back rest assembly adjacent the individual's lower lumbar region, while at the same time securing the elongated body member in a substantially horizontally disposed position on at least a portion of the lower lumbar region of the individual's back.

When the apparatus is properly secured on the individual at least a portion of the medial portion and the second portion of the elongated body member extend outwardly from the individual whereby, upon the individual assuming a ball striking position and simulating a ball striking motion bye rotating the hips, lower body and the upper body (chest), at least the second end portion of the elongated body member is caused to cross over a ball striking zone when the individual has properly rotated the hips, lower body and upper body during the ball striking (i.e. swinging) motion. Thus, the apparatus provides a visual indication as to whether the individual has properly rotated the hips, lower body and upper body (chest) when simulating a ball striking motion.

To further enhance proper upper body rotation relative to rotation of the hips, lower body and upper body, the apparatus further includes a rib support assembly operably connected to the elongated body member of the apparatus. The rib support assembly includes a first substantially vertically disposed member having a first end portion and a second end portion. The first substantially vertically disposed member is adjustably and rotatably connected to the elongated body member so that the distance the second end portion of the first substantially vertically disposed member extends above the elongated body member can be adjusted. A rib support member is mounted on the second end portion of the first substantially vertically disposed member for engaging a portion of the ribs of the individual substantially adjacent a rearwardly disposed arm of the individual when the individual assumes the ball striking position. A rib support strap is connected to the rib support member and is extendable about the chest of the individual such that, upon connecting the rib support strap about the individual's chest, the rib support strap and the rib support member-cooperate with the first substantially vertically disposed member, the support member and the back rest strap of the back rest assembly for securing and stabilizing the elongated body member in a substantially horizontally disposed position adjacent the lower lumbar region of the individual. Thus, in a connected position, at least a portion of the medial portion and the second end portion of the elongated body member extend outwardly from the individual whereby upon the individual assuming the ball striking position and rotating the hips, the lower body and upper body, at least a portion of the second end portion of the elongated body member is caused to cross over a ball striking zone when the individual has properly rotated the hips, the lower body and the upper body during rotation of the individual's body to simulate a ball striking motion, such as swinging a ball bat or golf club.

To enhance proper knee bend when rotating the lower body, hips and upper body (chest) during a ball striking movement, the apparatus may further include a second substantially vertically disposed member having a first end portion and a second end portion. The second substantially vertically disposed member is adapted to telescopically receive a portion of the first substantially vertically disposed member via the first end portion of the first substantially vertically disposed member such that the overall length of the first and second vertically disposed members can be adjusted relative to one another and to the elongated body member.

A propliteal fossa engaging member is connected to the first end portion of the second substantially vertically disposed member. A knee strap is connected to propliteal fossa engaging member. The knee strap is disposable about the leg of the individual for stabilizing the propliteal fossa engaging member against the propliteal fossa of the rearwardly disposed knee of the individual. Thus, upon securing the support member of the back rest assembly about the individual's waist so that the support member is positioned on at least a portion of the lower lumbar region of the individual and connecting the rib support member of the rib support assembly substantially adjacent a rearwardly disposed arm of the individual, the propliteal fossa engaging member engages the propliteal fossa of the rearwardly disposed knee of the individual to ensure proper back knee bend throughout body rotation when simulating a swing motion, such as when swinging a bat or golf club.

An object of the present invention is to provide an apparatus for ensuring proper upper and lower body rotation of an individual when striking a ball.

Another object of the present invention, while achieving the before stated object, is to provide an apparatus which provides a visual indication of swing faults of an individual so that the swing faults can be eliminated and thereby enhance the individual's ability to hit a ball consistently and with power.

Another object of the present invention, while achieving the before stated objects, is to provide an apparatus for conditioning the lower body, hips and upper body of an individual to move simultaneously when assuming a ball striking position and selectively rotating the hips, lower body and upper body (chest) during a ball striking movement.

Still another object of the present invention, while achieving the before stated objects, is to provide an apparatus which ensures proper back knee bend and body rotation of an individual while striking a ball.

These and other objects, advantages and features of the present invention will be readily apparent to those skilled in the art from a reading of the following detailed description in connection with the drawings and the appended claims.

DETAILED DESCRIPTION OF THE DRAWINGS

Figure 1:
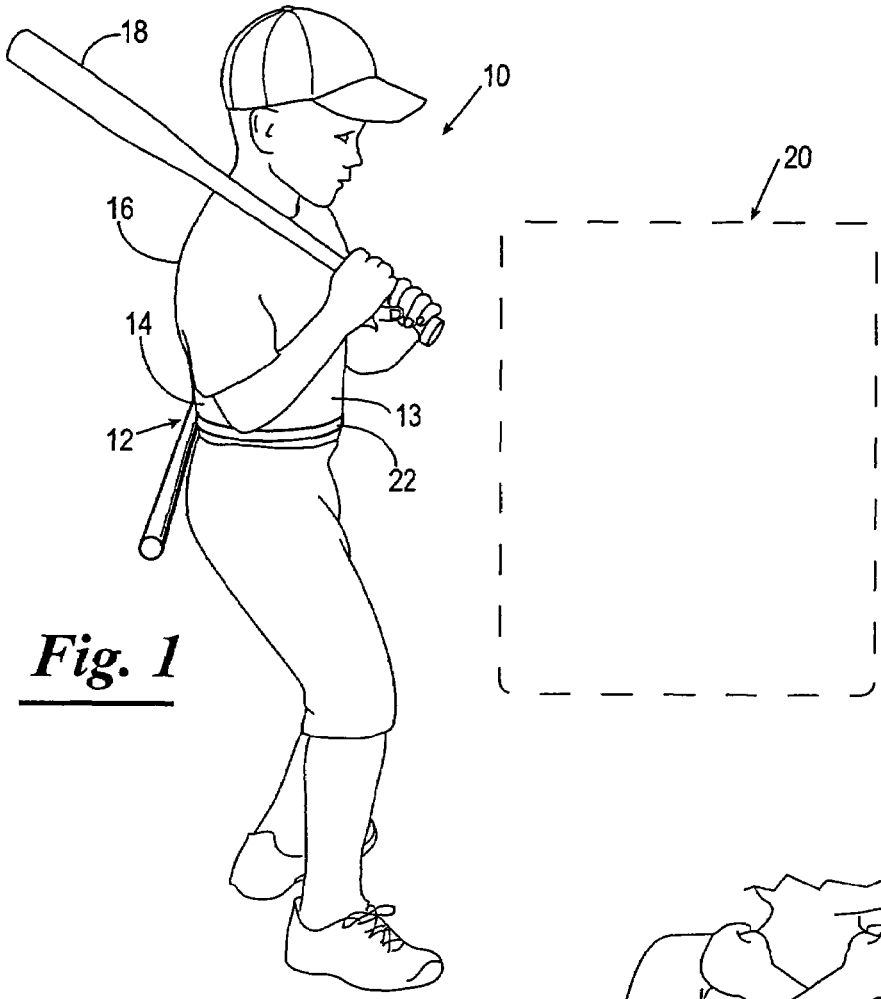
FIG. 1 is a pictorial representation of an individual having an apparatus constructed in accordance with the present invention disposed substantially adjacent the individual's lower lumbar region, the individual assuming a batting position.
Figure 1A:
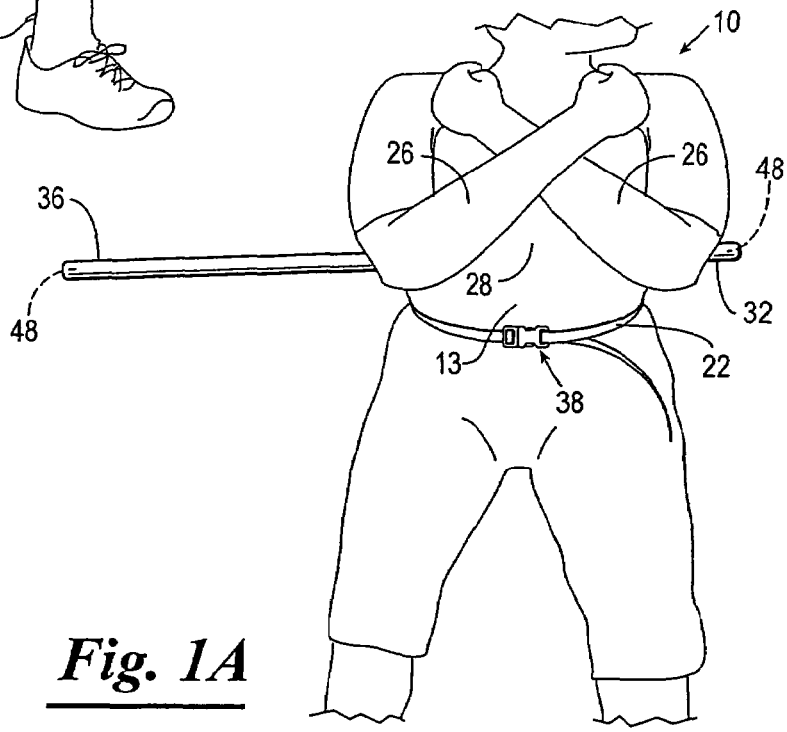
FIG. 1A is a fragmental, pictorial representation of an individual having the apparatus of FIG. 1 disposed substantially adjacent the individual's lower lumbar region, the individual assuming a batting stance and having their arms folded across their chest.

Referring now to the drawings, and more particularly to FIGS. 1 and 1A, shown therein is an individual 10 assuming a batting stance and having an apparatus 12 constructed in accordance with the present invention secured about a waist 13 of the individual 10. The apparatus 12 is supported adjacent a lower lumbar region 14 of a back 16 of the individual 10 so as to provide a visual indication of body rotation when the individual 10 swings a bat 18 through a ball striking zone 20 indicated by dashed lines in FIG. 1. The apparatus 12 is secured in a stable position on a portion of the lower lumbar region 14 of the individual's back 16 via a strap 22 disposed about the waist 13 of the individual 10. The individual 10 is shown in a batting stance holding the bat 18 (FIG. 1) such that upon proper rotation of the body during a swinging motion, a portion of the apparatus 12 extends into the ball striking zone 20 as the bat 18 passes through the ball striking zone 20 (FIG. 2).

In FIG. 1A, the individual 10 is shown in a position facing the ball striking zone (not shown). In this position the arms 26 of the individual 10 are folded across the chest 28 so that the swinging motion results only by rotation of the hips, lower body and upper body. That is, when the individual 10 assumes the stance shown in FIG. 1A, the individual's arms 26 do not impart any rotation to the individual's body.

Figure 2:
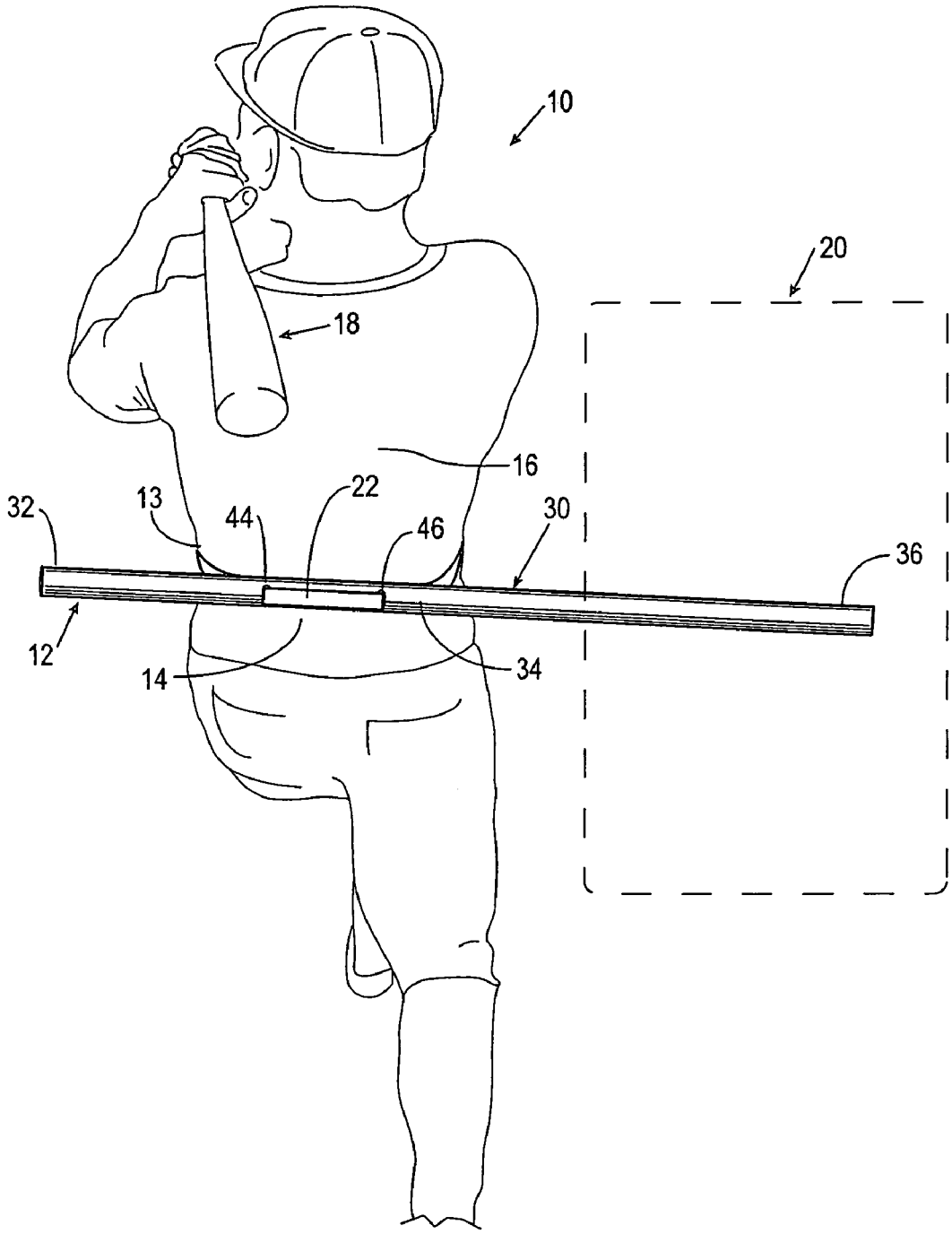
FIG. 2 is a fragmental, pictorial representation of the individual's shown in FIG. 1 wherein the individual has rotated the hips, lower body and upper body during a swinging motion whereby at least a portion of the apparatus of the present invention extends over a hitting zone.

As shown in FIG. 2, when the apparatus 12 is properly positioned on the lower lumbar region 14 of the individual 10, and when the individual 10 rotating the hips, lower body and upper body to simulate a ball striking movement, a portion of the apparatus 12 is caused to cross over the ball striking zone 20. Thus, the apparatus 12 provides the individual 10, as well as an instructor or coach (not shown), with the ability to visually observe rotation of the hips, lower body and upper body as the individual 10 swings the bat 18 through the ball striking zone 20 while at the same time allow the individual 10 to feel how a proper body rotation feels. As one can imagine, seeing and feeling are important because more often the individual 10 can do what the individual 10 sees and feels with more precision than what the individual 10 is taught. The ability to see and feel how something is supposed to work is one very important benefit of the apparatus 12.

Figure 3:
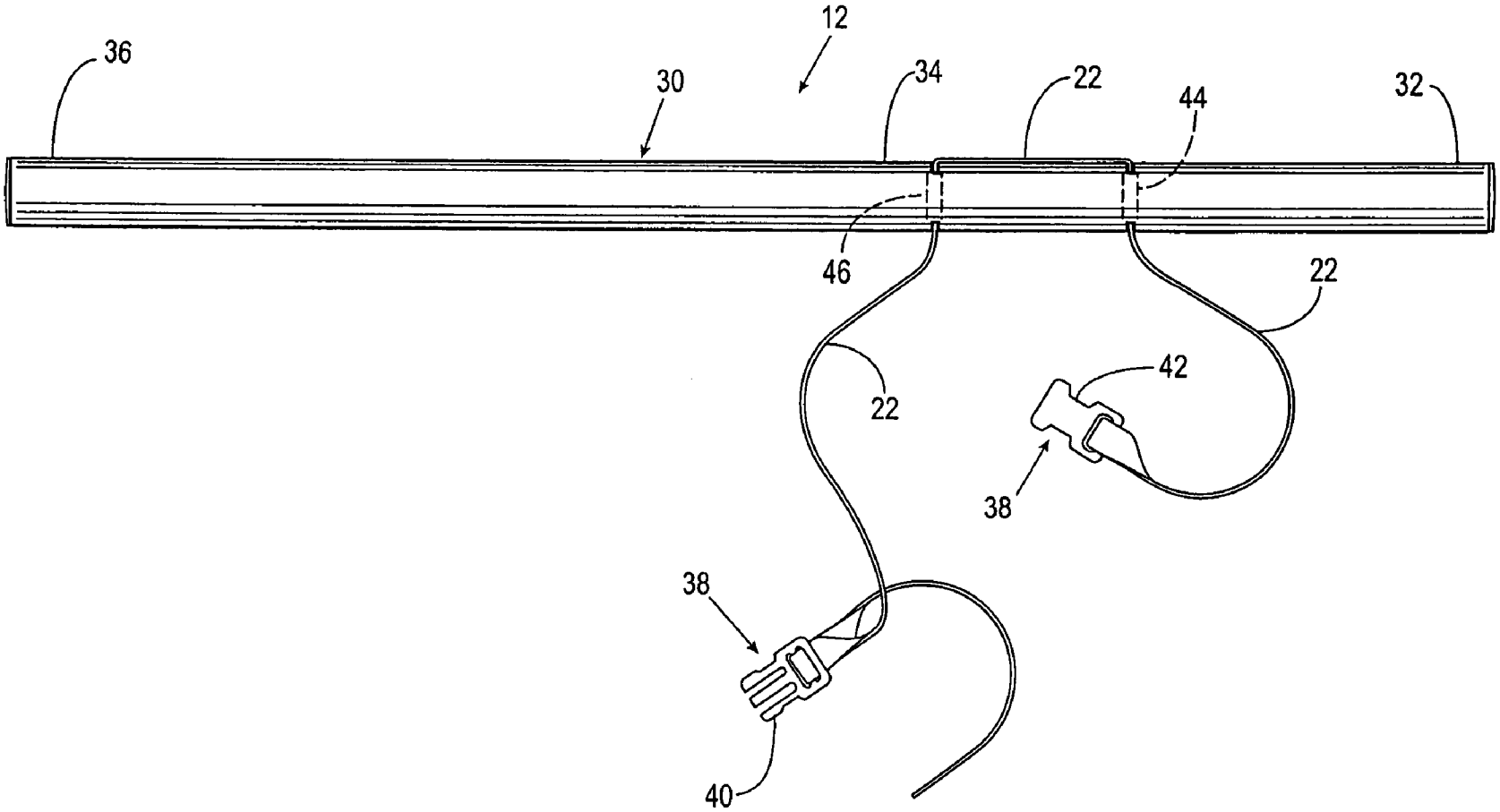
FIG. 3 is a top plan view of the apparatus of FIG. 1.

Referring now to FIGS. 2 and 3, the apparatus 12 is shown in more detail. As previously stated, the apparatus 12, when properly positioned upon the lower lumbar region 14 of the individual 10 (FIGS. 1, 1A and 2), provides a visual indication and teaches an individual 10 proper body rotation when striking a ball. The apparatus 12 includes an elongated body member 30 having a first end portion 32, a medial portion 34 and a second end portion 36. The strap 22 is connected to the elongated body member 30 at a position between the first end portion 32 and the medial portion 34 of the elongated body member 30 substantially as shown. The strap 22 is provided with a length sufficient to extend about the waist 13 of the individual 10. A connector assembly 38 (FIG. 3) is supported on the strap 22 for securing the strap 22 about the waist 13 of the individual 10 substantially as shown in FIGS. 1, 1A and 2. When properly positioned on the individual 10 the elongated body member 30 is substantially horizontally disposed on a portion of the lower lumbar region 14 of the back 16 of the individual 10 such that at least a portion of the medial portion 34 and the second end portion 36 of the elongated body member 30 extend outwardly from the individual 10 (FIGS. 1, 1A and 2). Thus, upon the individual 10 assuming a ball striking position (FIGS. 1 and 1A) and rotating the body (FIG. 2), at least the second end portion 36 of the elongated body member 30 is caused to cross over the ball striking zone 20 (FIG. 2) when the hips, lower body and upper body of the individual 10 are properly rotated during a swinging motion simulating the striking of a ball.

As shown in FIG. 3, the connector assembly 38 includes a male member 40 and a female member 42 which are secured on opposite end portions of the strap 22 so that, by connecting the male and female members 40 and 42, the strap 22 can be secured in a stable position about the waist 13 of the individual 10. The cross-sectional configuration of the strap 22 and the configuration of the male and female members 40 and 42 of the connector assembly 38, as well as the connection of the strap 22 to the elongated body member 30 of the apparatus 12 can vary, the only requirement being that the strap 22 be capable of being firmly connected to the elongated body member 30, and that the strap 22 have a length sufficient to extend about the waist 13 of the individual 10 so that the male and female member 40 and 42 of the connector assembly 38 can be connected and thereby secure the elongated body member 30 of the apparatus 10 in a stable position on the lower lumbar region 14 of the individual 10 substantially as shown in FIGS. 1, 1A and 2.

The use of the apparatus 10 enables an instructor or coach to teach the individual 10 to (a) properly step/stride at the pitch, (b) maintain proper knee bend throughout the swing, (c) distribute body weight throughout the swing, (d) establish weight on the pivot foot for stability throughout the swing, (e) position the body when the swing is finished, and (f) swing through balance and to keep the head and chest of the individual 10 behind the ball through impact. All of these practice drills require that the individual 10 complete the proper body movement while maintaining at least the second end portion 36 of the elongated body member 30 substantially horizontally on a swing plane towards the object to be struck, such as a ball.

The elongated body member 30 can be fabricated of any material capable of permitting the individual 10 to properly maintain the elongated body member 30 in a stable, substantially horizontally disposed position when the apparatus 12 is secured about the waist 13 of the individual 10. For example, the elongated body member 30 can be fabricated of wood, polymeric materials, aluminum, steel and the like. However, desirable results have been obtained wherein the elongated body member 30 is fabricated of PVC pipe having two spatially disposed slits or opening 44 and 46 adapted to receive the strap 22 so that the elongated body member 30 can be secured adjacent to the lower lumbar region 14 of the individual's back 16 by positioning the strap 22 about the waist 13 of the individual 10 and connecting the opposite end portions of the strap 22 via the male and female members 40 and 42 of the connector assembly 38 substantially as shown in FIG. 1A.

The length of the elongated body member 30 can vary widely and will depend to a large degree upon the size of the-individual 10 and the distance that the individual 10 stands from the ball striking zone 20 (FIG. 1). However, desirable results have been obtained wherein the elongated body member 30 is about 36 inches in length, has an outer diameter of about 1.5 inches and an inner diameter of about 1 inch. Similarly, the length of the strap 22 can vary widely depending upon the size of the waist 13 of the individual 10 utilizing the apparatus 12.

As previously stated, to secure the strap 22 about the waist 13 of the individual 10, the connector assembly 38 is supported on the strap 22. Any suitable male and female connectors well known in the art can be utilized as the male and female members 40 and 42 of the connector assembly 38 as long as the female and male connectors are capable of connecting portions of the strap 22 so that the strap 22 is secured in a stable, fixed position about the waist 13 of the individual 10 and the elongated body member 30 is maintained in a substantially horizontal position such that at least the second end portion 36 of the elongated body member 30 extends outwardly from the individual 10 substantially as shown in FIGS. 1, 1A and 2.

The apparatus 12 can also be used to warm-up the individual 10 prior to batting practice or before a game. Far too often only the arms 26 of the individual 10 are warmed up using a weighted bat. Such a warm-up procedure is inadequate in that the major muscles used in hitting or striking a ball are the lower-body muscles. Thus, by incorporating a weight, such as weights 48 (shown in phantom in FIG. 1A), in each of the first end portion 32 and the second end portion 36 of the elongated body member 30 of the apparatus 12, and securing the apparatus 12 on the individual 10 such that a portion of the elongated body member 30 is disposed adjacent the lower lumbar region 14, the apparatus 12 is converted into a warm-up and muscle strengthening/conditioning aid. Further, by using the weighted apparatus 12 as a warm-up and conditioning aid, the individual 10 will improve bat or club head speed, have an improved finishing position, as well as swing through balance.

When using the apparatus 12 having the weights 48 in the first and second end portions 32 and 36 of the elongated body member 30 to warm up, the amount of weight can vary depending on the size of the individual 10. Thus, the only requirement is that the weight in each of the first end portion 32 and the secured end portion 36 of the elongated body member 30 be substantially equal so as to provide a properly balanced elongated member 30.

Figure 4:
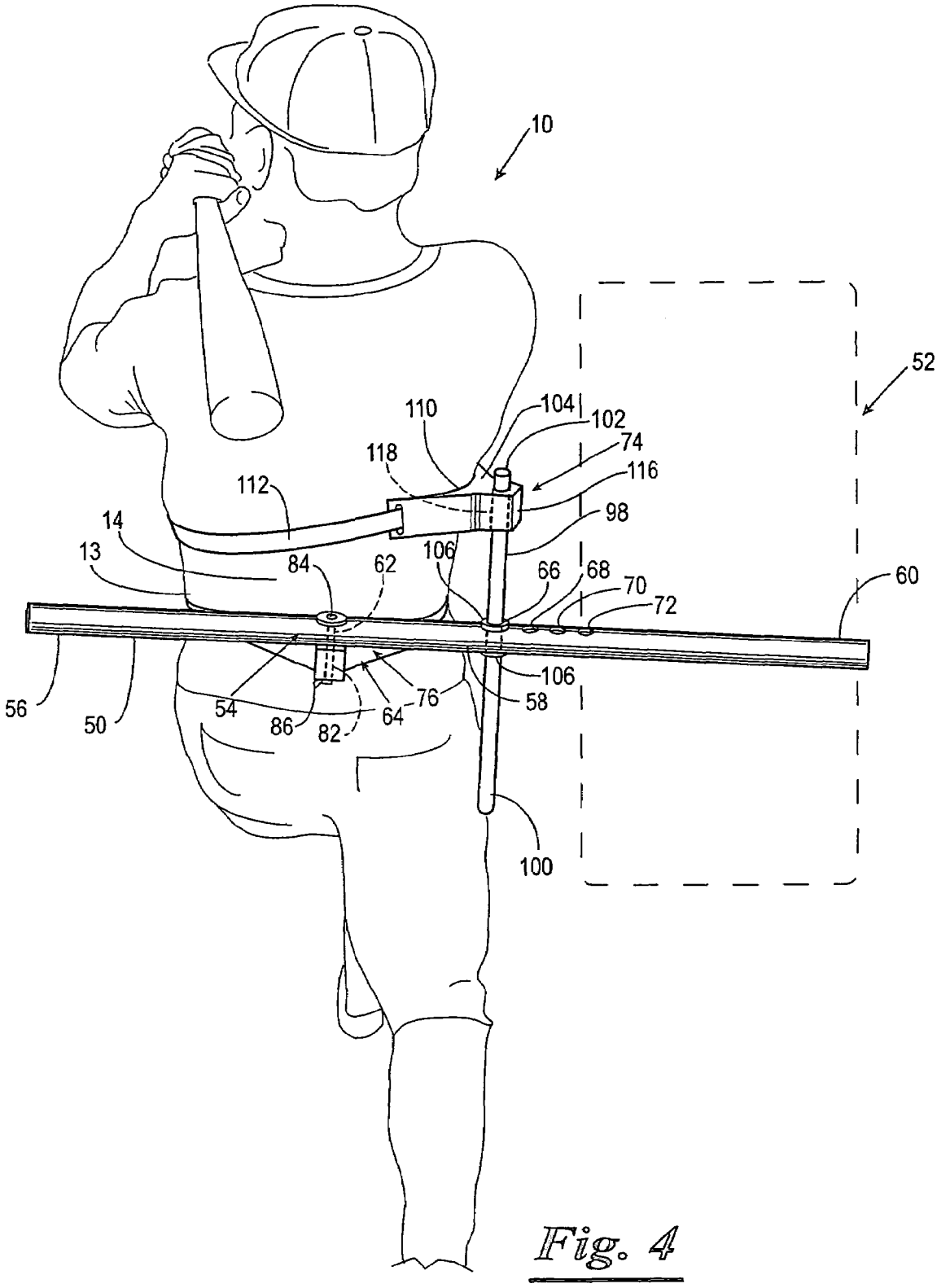
FIG. 4 is a pictorial representation of an individual having another embodiment of an apparatus constructed in accordance with the present invention disposed substantially adjacent the individual's lower lumbar region, the individual having stepped and pivoted the hips, lower body and upper body so that at least a portion of the apparatus extends over a hitting zone.

Referring now to FIG. 4, shown therein is a pictorial representation of the individual 10 having another embodiment of an apparatus 50 secured to the individual 10. The apparatus 50 is also designed to teach the individual 10 proper body rotation when striking a ball. A portion of the apparatus 50 is disposed substantially adjacent the lower lumbar region 14 of the individual 10. In the pictorial representation the individual 10 has stepped forward and pivoted the hips, lower body and upper body so that at least a portion of the apparatus 50 extends over a portion of a ball striking zone 52 in the same manner as a portion of the apparatus 10 extends over a portion of the ball striking zone 20 depicted in FIG. 2.

As shown in FIGS. 4-9, the apparatus 50 includes an elongated body member 54 having a first end portion 56, a medial portion 58 and a second end portion 60. The elongated body member 54 is shown as a tubular member having a sufficient length such that upon connecting the apparatus 50 to the individual 10 (as shown in FIG. 4), and the individual 10 rotates the hips, the lower body and the upper body, at least the second end portion 60 of the elongated body member 54 extends across the ball striking zone 52 in the same manner as the apparatus 12 herein before described with reference to FIGS. 1, 1A and 2.

An aperture 62 extends through the elongated body member 54 at a position in close proximity to the junction between the first end portion 56 and the medial portion 58 thereof so that a back rest assembly 64 can be connected to the elongated body member 54. The elongated body member 54 is further provided with a plurality of substantially aligned apparatus 66, 68, 70 and 72 extending through the medial portion 58 thereof for receiving a rib engaging assembly 74 as will be described in more detail hereinafter.

Figures 6, 7:
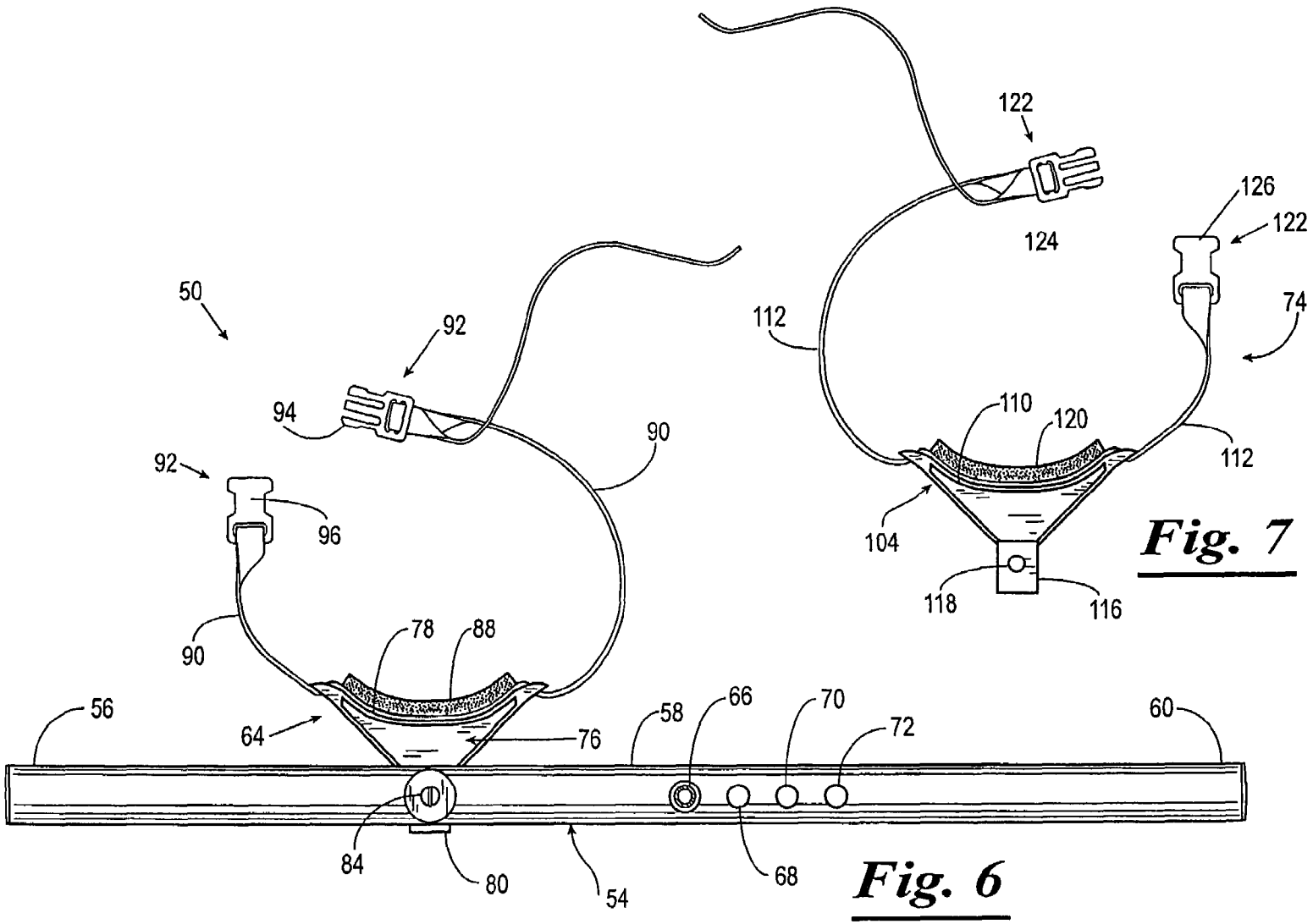
FIG. 6 is a top plan view of the apparatus of FIG. 5 taken along the line 6-6 thereof.
FIG. 7 is a pictorial top plan view of the apparatus of FIG. 5 taken along line 7-7 thereof.

The back rest assembly 64 is provided with a support member 76 having an inwardly disposed curved surface 78 and an outwardly extending neck portion 80 (see FIG. 6). The inwardly disposed curved surface 78 is configured so as to be positionable substantially adjacent at least a portion of the lower lumbar region 14 of the back 16 of the individual 10. The outwardly extending neck portion 80 of the back rest assembly 64 is provided with a aperture 82 (FIGS. 4, 5, 8 and 9) extending there through which is alignable with the apparatus 62 formed in the elongated support member 54. Thus, the back rest assembly 64 is connectable to the elongated support member 54 by inserting a bolt 84 through the apparatus 62 in the elongated support member 54, extending the bolt 84 through the aperture 82 provided in the outwardly extending neck portion 80 of the support member 76 of the back rest assembly 64 and securing same with a connecting member, such as wing nut 86. It should be noted that the back rest assembly 64 is connected to the elongated body member 54 such that the back rest assembly 64 can be pivotally moved to properly align the inwardly disposed curved surface 78 of the support member 76 adjacent at least a portion of the lower lumbar region 14 of the back 16 of the individual 10 substantially as shown in FIG. 4.

The back rest assembly 64 of the apparatus 50 further includes a pad or cushion 88 disposed on the inwardly disposed curved surface 78 of the support member 76 and a back rest strap 90 which is extendable about the waist 13 of the individual 10 when the support member 76 is positioned on at least a portion of the lower lumbar region 14 of the individual 10. Once extended about the waist 13 of the individual 10, the back rest strap 90 is connected via a back rest strap connecting assembly 92 so as to secure the back rest strap 90 about the waist 13 of the individual and thereby stabilize the support member 76, and thus secure the elongated body member 54 in a substantially horizontally disposed position of at least a portion of the lower lumbar region 14 of the individual 10.

Figure 5:
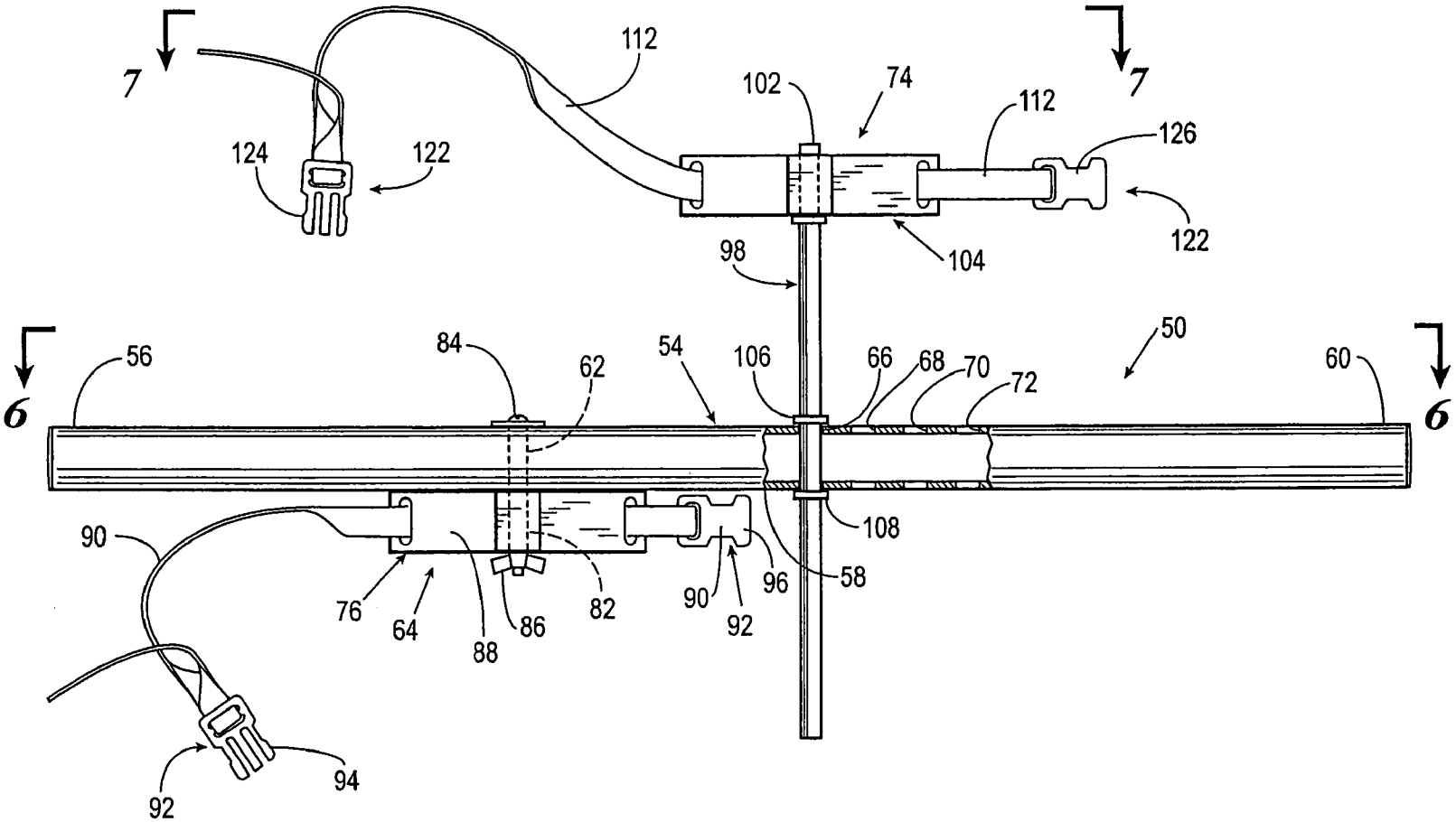
FIG. 5 is a partial cutaway, elevational view of the apparatus of FIG. 4.
Figure 9:
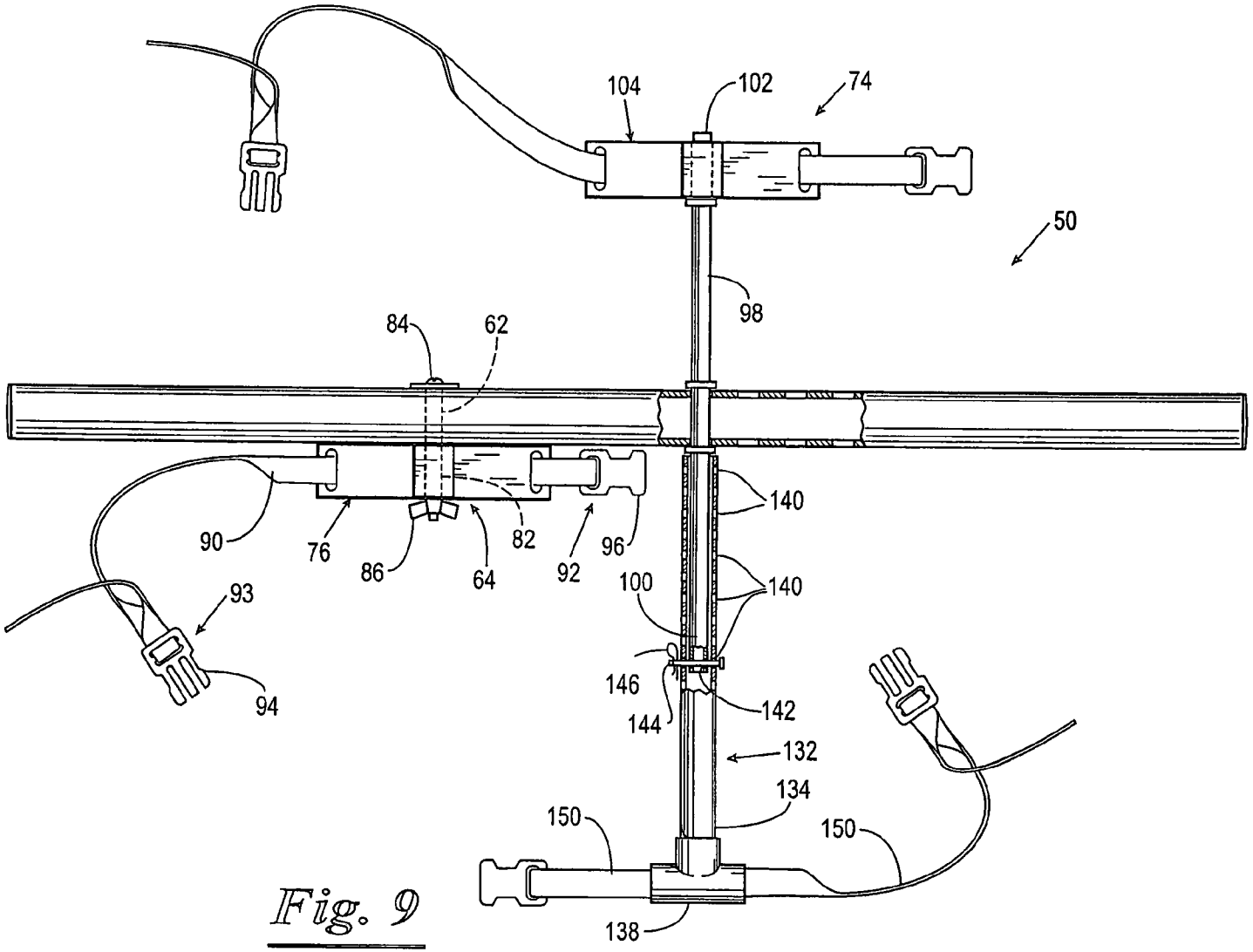
FIG. 9 is a partial cutaway, elevational view of the apparatus of FIG. 8.

The back rest strap connecting assembly 92 is shown in FIGS. 5 and 9 as having a male member 94 and a female member 96 which are adapted to be matingly connected. However, it should be understood that any connecting assembly capable of securing the back rest strap 90 about the waist 13 of the individual 10 can be employed as the backrest strap connecting assembly 92. Such connector assemblies are well known and include, but are not limited to, buckles, snaps, velcro-type connectors, as well as tying the back rest strap 90 about the waist 13 of the individual 10.

Figure 8:
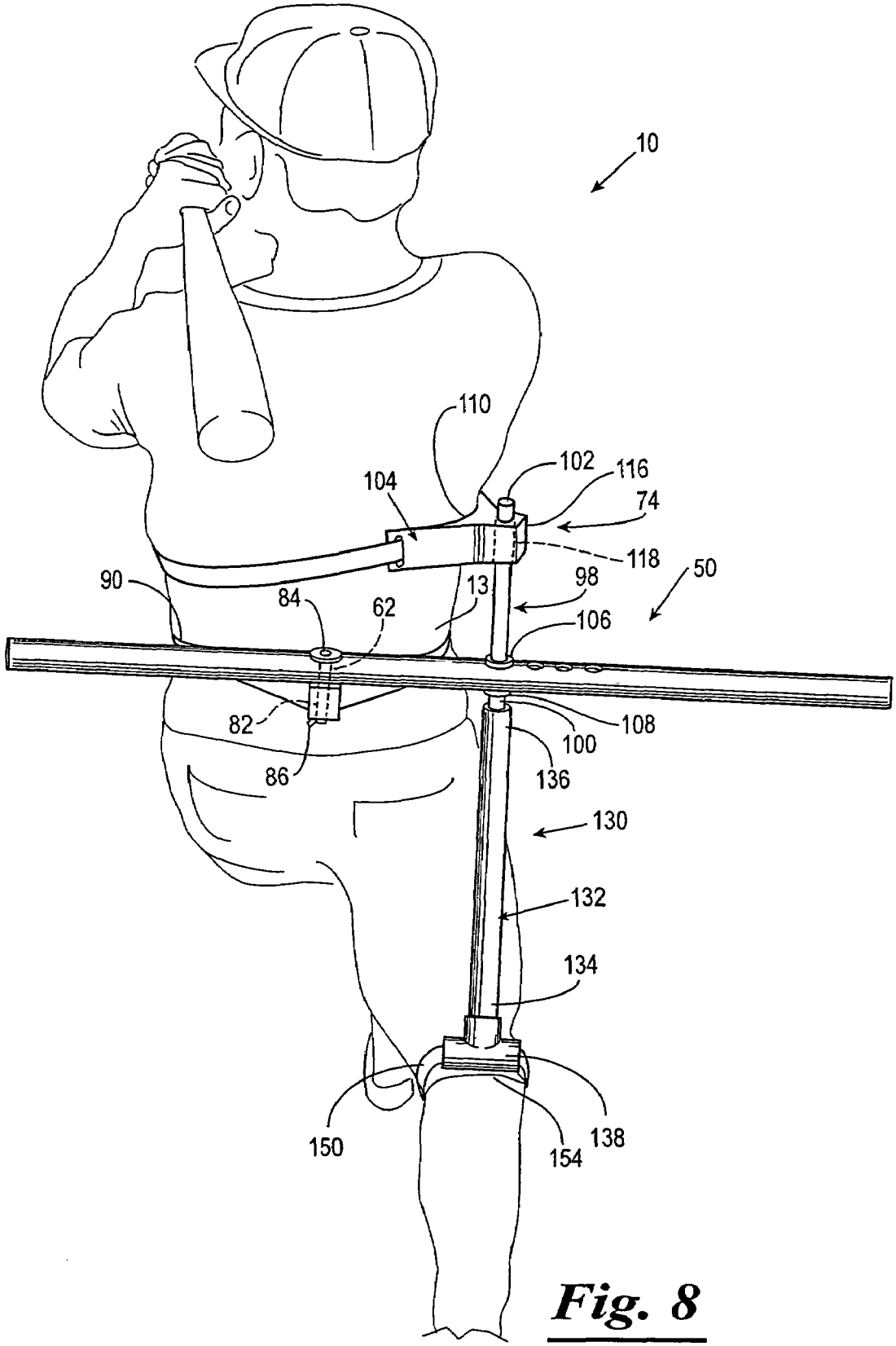
FIG. 8 is a fragmental, pictorial representation of an individual having apparatus of FIG. 5 disposed substantially adjacent the individual's lower lumbar region, the apparatus having a propliteal fossa engaging assembly for enhancing proper rear knee bend as the individual rotates the individual's hips, lower body and upper body-during a swinging motion.

As shown in FIGS. 4 and 8, once the back rest strap 90 is extended about the waist 13 of the individual 10 and the back rest strap 90 is connected via the back rest strap connecting assembly 92, the support member 76 of the back rest assembly 64 and the elongated body member 54 are stabilized on the individual 10 such that the elongated body member 54 is substantially horizontally disposed. When properly secured on the individual 10 at least a portion of the medial portion 58 and the second end portion 60 of the elongated body member 54 extend outwardly from the individual 10 such that upon a individual 10 assuming a ball striking position and simulating a ball striking motion whereby the hips, lower body and upper body (chest) are rotated, at least the second end portion 60 of the elongated body member 54 is caused to extend over at least a portion of the ball striking zone 52 when the individual 10 has properly rotated the hips, lower body and upper body during the ball striking (i.e. swinging) motion. Thus, when the apparatus 50 is properly connected to the individual 10 and the individual 10 has preformed a ball striking motion, the apparatus 10 provides a visual indication as to whether or not the individual 10 has properly rotated the hips, lower body and upper body (chest) when simulating the ball striking motion.

To further enhance proper upper body rotation relative to rotation of hips and lower body, the rib support assembly 74 of the apparatus 50 is connected to the elongated body member 54. The rib support assembly 74 includes a first substantially vertically disposed member 98 having a first end portion 100 and a second end portion 102. A rib support member 104 is disposed on the second end portion 102 of the first substantially vertically disposed member 98. The first substantially vertically disposed member 98 is adjustably and rotatably connected, to the elongated body member 54 so that the distance between the elongated body member 54 and the rib support member 104 can be adjusted based on the height and size of the individual 10 using the apparatus 50 and the disposition of the rib support member 104 can be adjusted for proper positioning on a portion of the rib cage of the individual 10.

As previously stated, the elongated body member 54 is provided with the plurality of aligned, spatially disposed apertures 66, 68, 70 and 72 provided in the medial portion 58 of the elongated body member 54. The rib support assembly 74 is connected to the elongated body member 54 by inserting the first end portion 100 of the first substantially vertically disposed member 98 of the rib support assembly 74 through one of the aligned aperture, such as the aperture 66, formed in the medial portion 58 of the elongated body member 54. The first substantially vertically disposed member 98 can be secured in a stable position within the aperture 66 by any suitable mechanism known in the art, such as grommets 106 and 108, the only requirement being that the first substantially vertically disposed member 98 be stabilized relative to the elongated body member 54.

As previously stated, the rib support member 76 is disposed on the second end portion 102 of the first substantially vertically disposed member 98 such that the rib support member 76 is adapted to engage a portion of the ribs of the individual 10 substantially adjacent a rearwardly disposed arm 26 of the individual 10 when the individual 10 assumes the ball striking position. The rib support member 76 is provided with an arcuate-shaped rib supporting surface 110 for enhancing positioning of the rib support member 76 adjacent a portion of the rib area of the individual 10, while at the same time providing comfort to the individual 10 having the rib support member 76 secured about the chest 28 of the individual 10 as will be described in more detail hereinafter.

A rib support strap 112 is connected to the rib support member 76. The rib support strap 112 is provided with a sufficient length so that the rib support strap 112 can be extended about the chest 28 of the individual 10 whereby, upon securing the rib support strap 112 about the chest 28 of the individual 10, the rib support member 104 cooperates with the first substantially vertically disposed member 98 of the rib support assembly 74 and the back rest assembly 64 to stabilize the elongated body member 54 of the apparatus 50 in a substantially horizontally disposed position adjacent a portion of the lower lumbar region 14 of the back 16 of the individual 10.

As more clearly shown in FIG. 7, the rib support member 104 is provided with the arcuate-shaped rib supporting surface 110 and an outwardly extending neck portion 116 having an aperture 118 extending therethrough. The arcuate-shaped rib supporting surface 110 is configured so as to be positionable adjacent a portion of the ribs of the individual 10. The outwardly extending neck portion 116 of the rib support member 104 is connectable to the second end portion 102 of the first substantially vertically disposed member 98 by extending either the first end portion 100 or the second end portion 102 of the first substantially vertically disposed member 98 through the aperture 118 formed through the outwardly extending neck portion 116 of the rib support member 104. The aperture 118 can be sized such that the rib support member 104 is frictionally held in place on the second end portion 102 of the first substantially vertically disposed member 98; or grommets (not shown) or bolts and the like can be employed in a manner well known in the art for stabilizing the rib support member 104 on the second end portion 102 of the first substantially vertically disposed member 98.

The rib support member 104 of the rib support assembly 74 is further provided with a pad or cushion 120 disposed on the arcuate-shaped rib supporting surface 110 of the rib support member 104; and the rib support strap 112 is connected to the rib support member 104 in such a manner as to be extendable about the chest 28 of the individual 10 and secured about the chest 28 of the individual 10 by connecting the rib support strap 112 via a rib support strap connector assembly 122.

The rib support strap connecting assembly 122 is shown in FIGS. 5 and 7 as having a male member 124 and a female member 126 which are adapted to be matingly connected. However, it should be understood that any assembly capable of connecting the rib support strap 112 about the chest 28 of the individual 10 can be employed as the rib-support strap connecting assembly 122 in accordance with the present invention. Such connector assemblies are well known and include, but are not limited too, buckles, snaps, velcro-type connectors, as well as tying the rib support strap 112 about the chest 28 of the individual 10.

As previously stated, the first substantially vertically disposed member 98 of the rib support assembly 74 is adjustably and rotatably connected to the elongated body member 54 so that the length of the first substantially vertically disposed member 98 can be varied relative to the elongated body member 54 and the rib support member 104 of the rib support assembly 74 is likewise adjustably and rotatably connected to the second end portion 102 of the first substantially vertically disposed member 98 so that the rib support member 104 can be adjusted for proper positioning on a portion of the rib cage of the individual 10. Thus, the connection of the first substantially vertically disposed member 98 to the elongated body member 54, and the connection of the rib support member 74 to the second end portion 102 of the first substantially vertically disposed member, enables one to readily adjust the rib support assembly 74 so that the rib support member 104 can be positioned below the rearward arm 28 of the individual 10 when the individual 10 is in a ball striking position. That is, by adjustably and rotatably connecting the first substantially vertically disposed member 98 to the elongated body member 54, and the rib support member 104-to the second end portion 102 of the first substantially vertically disposed-member 98, the rib support member 104 can be readily positioned adjacent a portion of the rib cage of the individual 10 at a position below the rearwardly disposed arm 26 of the individual 10 when the individual 10 is in the ball striking position. For example, if the individual 10 is utilizing the apparatus 50 to assist in proper hip, lower and upper body rotation when simulating the striking of a baseball or softball and the individual 10 is a right handed batter, the rib support member 104 will be positioned below the right armpit and substantially adjacent at least a portion of the rib cage; whereas, if the individual 10 is a left handed batter, the rib support member 104 will be positioned below the left armpit and adjacent at least a portion of the rib cage of the individual 10 when the individual 10 assumes a ball striking position.

The configuration of the support member 76 of the back rest 64 and the rib support member 104 of the rib support assembly 74 can vary widely as long as the support member 76 and the rib support member 104 can be properly and comfortably positioned adjacent the lower lumbar region 14 and a portion of the rib cage of the individual 10, respectively. Similarly, the length of the back rest strap 90 and the rib support strap 112 can vary widely and will be dependent to a large degree upon the size of the individual 10 utilizing the apparatus 50. The only requirement is that the back rest strap 90 be of sufficient length to extend about the waist 13 of the individual 10 such that upon connecting the back rest strap 90 about the waist 13 of the individual 10, the back rest strap 90 secures and stabilizes the support member 76 of the back rest assembly 64 adjacent the lower lumbar region 14 of the individual 10 and the elongated body member 54 in a substantially horizontally disposed position on at least a portion of the lower lumbar region 14 of the back 16 of the individual 10. Similarly, the only requirement of the rib support strap 112 is that the rib support strap 112 be of sufficient length to extend about the chest 28 of the individual 10 such that, upon connecting the rib support strap 112 about the chest 28 of the individual 10, the rib support strap 112 securely positions and maintains the rib support member 104 adjacent a portion of the rib cage of the individual 10. Thus, the rib support strap 112 of the rib support assembly 74 cooperates with the first substantially vertically disposed member 98, and the back rest 90 of the back rest assembly 64 to secure and stabilize the elongated body member 54 in a substantially horizontally disposed position adjacent the lower lumbar region 14 of the back 16 of the individual 10 when the individual 10 assumes a ball striking position. Thereafter, upon simulating a swing or ball striking motion, at least the second end portion 60 of the elongated body member 54 is caused to cross over at least a portion of the ball striking zone 52 when the hip, lower body and upper body of the individual 10 are properly rotated during the ball striking-motion. Thus, the position of the elongated body member 54 relative to the ball striking zone 52 provides a visual indication of whether or not the individual has properly rotated the hips, lower body and upper body when simulating a swing or ball striking motion.

To enhance proper knee bend of a rear leg of the individual 10 when the individual 10 is in a ball striking stance and steps forward as the hips, lower body and upper body are rotated during the ball striking or swinging motion as illustrated in FIG. 8, the apparatus 50 further includes a propliteal fossa engaging assembly 130 connected to the first end portion 100 of the first substantially vertically disposed member 98 of the rib support assembly 74. The propliteal fossa engaging assembly 130 includes a second substantially vertically disposed member 132 having a first end portion 134 and a second end portion 136. The second substantially vertically disposed member 132 of the propliteal fossa engaging assembly 130 is adapted to telescopically receive a portion of the first substantially vertically disposed member 98 of the rib support assembly 74 via the first end portion 100 of the first substantially vertically disposed member 98. Thus, the overall length of the first and second vertically disposed members 98 and 132 of the rib support assembly 74 and the propliteal fossa engaging assembly 130, respectively, can be selectively adjusted relative to one another so that the distance of a propliteal fossa engaging member 138 connected to the first end portion 134 of the second substantially vertically disposed member 132 from the elongated body member, 54 of the apparatus 50 can be selectively varied.

To connect the first end portion 100 of the first substantially vertically disposed member 98 of the rib support assembly 74 to the second substantially vertically disposed member 132 of the propliteal fossa engaging assembly 130, the second end portion 136 of the second substantially vertically disposed member 132 of the propliteal fossa engaging assembly 130 is provided with a plurality of aligned apertures 140 extending along a substantial portion of the second end portion 136 of the second substantially vertically disposed member 132 substantially as shown in FIG. 9. Similarly, an aligned aperture 142 is provided in the first end portion 100 of the first substantially vertically disposed member 98 of the rib engaging assembly 74 such that upon disposing the first end portion 100 of the first substantially vertically disposed member 98 of the rib support assembly 74 into the second end portion 136 of the second substantially vertically disposed member 132 of the propliteal fossa engaging assembly 130, and aligning the aperture 142 in the first end portion 100 of the first substantially vertically disposed member 98 with a selected aligned aperture 140 in the second end portion 136 of the second substantially vertically disposed member 132 of the propliteal fossa engaging assembly 130, and inserting a pin or bolt 144 through the aligned apertures 140 and 142 and securing the pin or bolt with a cotter pin 146, the second substantially vertically disposed member 134 of the propliteal fossa engaging assembly 130 is stabilized relative to the first substantially vertically disposed member 98 of the rib engaging assembly 74.

As previously stated, the propliteal fossa engaging member 138 is connected to the first end portion 134 of the second substantially vertically disposed member 132. A knee strap 150 is connected to the propliteal fossa engaging member 138. The length of the knee strap 150 can vary widely, the only requirement being that it have sufficient length so that the knee strap 150 can be positioned about a leg of the individual 10 for stabilizing the propliteal fossa engaging member 138 against the propliteal fossa 152 of a rearwardly disposed knee of the individual 10. As previously stated, the overall length of the second substantially vertically disposed member 132 of the propliteal fossa engaging assembly 130 and the first substantially vertically disposed member 98 of the rib support assembly 74 can be varied. Thus, upon securing the support member 76 of the back rest assembly 64 on the back 16 of the individual 10 by extending the back rest strap 90 about the waist 13 of the individual 10 so that the support member 76 of the back rest assembly 64 is positioned on at least a portion of the lower lumbar region 14 of the individual 10, and securing the rib support member 104 of the rib support assembly 74 adjacent a portion of the rib cage of the individual 10 substantially adjacent the rearwardly disposed arm 26 of the individual 10, the propliteal fossa engaging member 138 of the propliteal fossa engaging assembly 130 engages the propliteal fossa 152 of the rearwardly disposed knee of the individual 10 to ensure proper back knee bend throughout body rotation when simulating a swing motion such as when swinging a bat or golf club.

Figure 10:
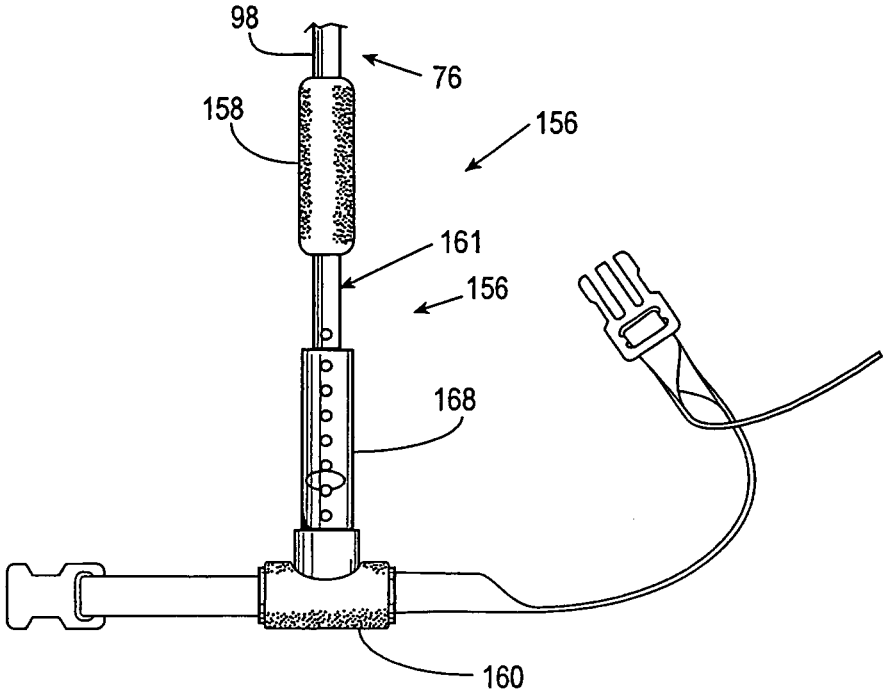
FIG. 10 is a fragmental elevational view of another embodiment of a propliteal fossa engaging assembly of the apparatus constructed in accordance with the present invention.
Figure 11:
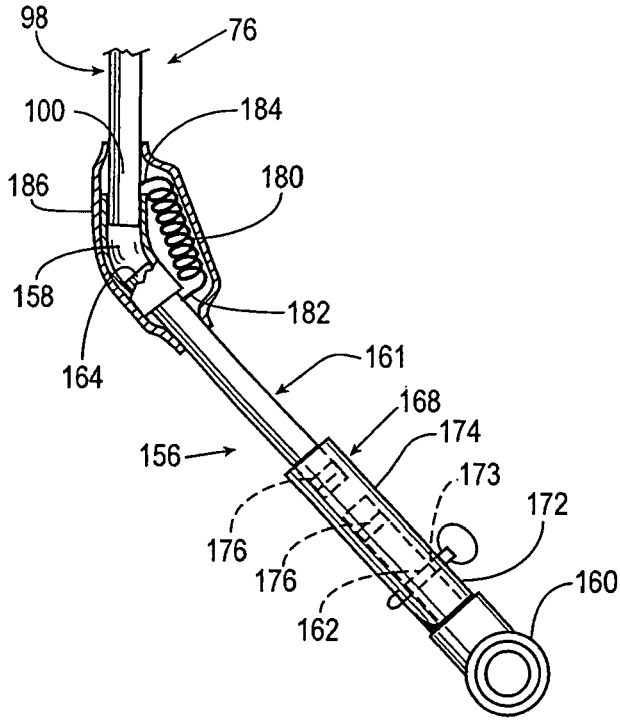
FIG. 11 is a partially cutaway, fragmental side elevational view of the propliteal fossa engaging assembly of FIG. 10 taken along line 11-11 thereof.

Referring now to FIGS. 10 and 11, shown therein is a partially cutaway, elevational view of another embodiment of a propliteal fossa engaging assembly 156 connected to the first end portion 100 of the first vertically disposed member 98 of the rib support assembly 76 hereinbefore described. The propliteal fossa engaging assembly 156 functions in a similar manner to the propliteal fossa engaging assembly 130 heretofore described with reference to the apparatus 50, but in the embodiment shown in FIGS. 10 and 11, the propliteal fossa engaging assembly 156 is provided with a flexible elbow 158 which enables a propliteal fossa engaging member 160 to be flexibly moved relative to the first substantially vertically disposed member 98 of the rib support assembly 74 of the apparatus 50 to enhance bending of the knee during a swinging motion.

The propliteal fossa engaging assembly 156 includes, in addition to the flexible elbow 158, an extension or leg member 161 having a first end portion 162 and a second end portion 164. The second end portion 164 of the extension or leg member 161 is connected to the first end portion 100 of the first substantially vertically disposed member 98 of the rib support assembly 74 via the flexible elbow 158. The propliteal fossa engaging assembly 156 is further provided with a substantially a barrel or stem member 168 adapted to telescopically receive the first end portion 162 of the extension or leg member 161; and the propliteal fossa engaging member 160 is connected to a distal end 172 of the barrel or stem member 161 such that the propliteal fossa engaging member 160 is substantially normally disposed relative to an elongated axis of the barrel or stem member 168.

The barrel or stem member 168 is provided with a threaded aperture 173 (shown in phantom) extending through a side wall 174 of the barrel or stem member 168; and the extension or leg member 161 is provided with a plurality of spatially disposed apertures 176 (shown in phantom) extending along a portion of the extension or leg member 161 telescopically disposed within the barrel or stem member 168 of the propliteal fossa engaging assembly 166. Thus, to connect the extension or leg member 161 to the barrel or stem member 168, a portion of the first end portion 162 of the extension or leg member 161 is telescopically disposed in the barrel or stem member 168 of the propliteal fossa engaging assembly 166, the threaded aperture 173 extending through the sidewall 174 of the barrel or stem member 168 is aligned with a selected aperture 176 in the extension or leg member 161 and a connector member or pin, such as a thumb screw 178, is disposed through the threaded aperture 173 in the sidewall 174 of the barrel or stem member 168 and the aligned aperture 176 in the extension or leg member 161.

The propliteal fossa engaging assembly 156 further includes a spring 180 having a first end portion 182 and a second end portion 184, and a housing 186 disposable over the flexible elbow 158 and the spring 180. The first end portion 182 of the spring 180 is connected to the second end portion 164 of the extension or leg member 161 and the second end portion 184 of the spring 180 is connected to the first end portion 100 of the first substantially vertically disposed member 98 of the rib support assembly 74 and so that the spring 180 extends along the flexible elbow 158 and biases the extension or leg member 160 at an angle relative to the first substantially vertically disposed member 98 of the rib support assembly 74 substantially as shown in FIG. 11. It should be noted that by biasing the propliteal fossa engaging member 160, the propliteal fossa engaging member 160 is maintained in contact with the propliteal fossa of the rear leg of the individual 10 during the striding motion as the individual 10 steps into and rotates the hips, lower body and upper body during a swinging motion.

The housing 186, is fabricated of a resilient material (such as a flexible polymeric material) and the housing 186 is connected to the first end portion 100 of the first substantially vertically disposed member 98 of the rib support assembly 74 and the second end portion 164 of the extension or leg member 161 of the propliteal fossa engaging assembly 156 so that the housing 186 encapsulates the flexible elbow 158 and the spring 180.

In practicing the present invention it should be known that various components of the apparatus 12 and the apparatus 50 can be interchanged without departing from the inventive concept. That is, if desired, the apparatus 10 can be provided with a back rest assembly similar to the back rest assembly 64 of the apparatus 50. Similarly, the elongated body member 54 of the apparatus 50 can be provided with spatially disposed slits or openings such as the slits or openings 44 and 46 of the elongated body member 30, in which case a strap would be threadably disposed through the aligned slits and the strap used to secure the elongated body member about the waist 13 of the individual 10.

When using either the apparatus 12 or the apparatus 50 to instruct the individual 10 on proper body rotation when attempting to strike a ball, one chooses the particular apparatus based upon the size, stature and abilities of the individual 10. To use the apparatus 12, the only requirement is that the elongated body member 30 be supported on the lower lumbar region 14 of the individual 10 and secured on the individual 10 such that the medial portion 34 and the second end portion 36 of the elongated body member 30 extends outwardly from the individual 10 in a substantially parallel position.

On the other hand, when employing the apparatus 50, one must first determine what components of the apparatus 50 are to be used in the training exercise. For example, if desired the elongated body member 54 can be supported on the lower lumbar region 14 of the individual 10 by disposing the back rests strap 90 about the waist 13 of the individual 10 and securing the back rest strap 90 about the waist 13 such that the elongated body member 54 is maintained in a substantially horizontal position whereby at least a portion of the medial portion and the second end portion 60 of the elongated body member 54 extend outwardly from the individual 10. If, however, the apparatus is to be used with the rib support assembly 74, the rib support assembly 74 is connected to the elongated body member 54 of the apparatus 50 in the manner heretofore described. Thereafter, the length of the first substantially vertically disposed member 98 of the rib support assembly 74 is adjusted so that the rib support member 104 is properly disposed adjacent a portion of the rib cage of the individual 10 at a position substantially adjacent the rearwardly disposed arm of the individual 10.

In order to provide the apparatus 50 with a propliteal fossa engaging assembly, such as the propliteal fossa engaging assembly 130 or the propliteal fossa engaging assembly 156, the desired propliteal fossa engaging assembly 130 or 156 is connected to the first end portion of the first substantially vertically disposed member 98 of the rib support assembly 74 as hereinbefore described. The distance of the propliteal fossa engaging member from the elongated body member 54, such as the propliteal fossa engaging member 138 or 160 is adjusted as hereinbefore described so that upon disposing the propliteal fossa engaging member 138 or 160 adjacent the propliteal fossa of the rearwardly disposed knee of the individual 10, the propliteal fossa engaging member 138 or 160 cooperates with the back rest assembly 64 and the rib support assembly 74 to enhance proper body rotation and knee bend of the individual 10 when the individual 10 simulates a swinging motion to strike a ball.

As will become apparent to those skilled in the art, changes may be made in the construction and the operation of the various components, elements and assemblies of the apparatus described herein or in the steps or the sequence of steps of the methods using the apparatus described herein without departing from the spirit and scope of the invention as defined in the following claims.

What is claimed is:

1. An apparatus for teaching an individual proper body rotation when swinging a bat, the apparatus comprising:

an elongated body member having a first end portion, a medial portion and a second end portion;

a back rest mounted at a position between the first end portion and the medial portion of the elongated body member, the back rest positionable on at least a portion of a lower lumbar region of the individual;

a back rest strap connected to the back rest so as to be extendable about a waist of the individual when the back rest is positioned on at least a portion of the lower lumbar region of the individual;

a back rest strap connector means supported on the back rest strap for securing the back rest strap about the waist of the individual, the back rest strap connector means cooperating with the back rest strap and the back rest to stabilize the elongated body member in a substantially horizontally disposed position on at least a portion of the lower lumbar of the individual such that at least a portion of the medial portion and the second end portion of the elongated body member extend outwardly from the individual whereby, upon the individual assuming a batting position and rotating the hips, lower body and upper body, at least the second end portion of the elongated body member is caused to cross over a ball striking zone when the individual has properly rotated the hips, lower body and upper body during a swinging motion simulating striking of a ball passing through the ball striking zone;

a first substantially vertically disposed member having a first end portion and a second end portion, the first substantially vertically disposed member adjustably and rotatably connected to the elongated body member so that the distance between the second end portion of the first substantially vertically disposed member relative to the elongated body member can be selectively varied;

a rib support mounted on the second end portion of the first substantially vertically disposed member for engaging a portion of the individual's ribs substantially adjacent a rearwardly disposed arm of the individual when the individual assumes the ball striking position;

a rib support strap connected to the rib support and extend able about the individual's chest; and rib strap connector means supported on the rib support strap for securing the strap about the individual's chest, the rib strap connector means, the rib support strap and the rib support cooperating wit the first substantially vertically disposed member, the back rest, the back rest strap and the back rest strap connector means for securing and stabilizing the elongated body member in a substantially horizontally disposed position on at least a portion of the lower lumbar region of the individual's back whereby at least a portion of the medial portion and the second end portion of the elongated body member extend outwardly from the individual so that, upon the person assuming the ball striking position and rotating the hips, lower body and upper body, at least a portion of the second end portion of the elongated body member is caused to cross over at least a portion of a ball striking zone when the individual has properly rotated the hips, lower body and upper body during the swinging motion simulating striking of the ball passing through the ball striking zone.

2. The apparatus for teaching an individual proper body rotation when swinging a bat of claim 1 further comprising:

a propliteal fossa engaging assembly connected to the first end portion of the first substantially vertically disposed member, the propliteal fossa engaging assembly comprising:

an extension member having a first end portion and a second end portion;

a flexible elbow extending between and connected to the first end portion of the first substantially vertically disposed member and the second end portion of the extension member;

a barrel member having a propliteal fossa engaging member adapted to telescopically receive the first end portion of the extension member;

a propliteal fossa engaging member disposed on a distal end of the barrel member;

connector means for connecting the extension member to the barrel member; and biasing means extending between the first end portion of the first substantially vertically disposed member and the second end portion of the extension member for biasing the extension member and the barrel member inwardly toward an adjacently disposed knee such that the propliteal fossa engaging member contacts the propliteal fossa of the adjacently disposed knee as the individual rotates the body during a swinging motion so as to enhance proper knee bend during the swinging motion.

3. The apparatus for teaching an individual proper body rotation when swinging a bat of claim 2 wherein the biasing means comprises a spring having a first end portion and a second end portion, the first end portion of the spring connected to the second end portion of the extension member and the second end portion of the spring connected to the first end portion of the first substantially vertically disposed member such that the spring extends there between, and wherein the propliteal fossa engaging assembly further comprises a flexible housing disposed over the spring and extending between having a first end portion and a second end portion, the first end portion of the first substantially vertically disposed member and the second end portion of the extension member.

4. The apparatus for teaching an individual proper body rotation when swinging the bat of claim 1 further comprising a propliteal fossa engaging assembly connected to the first end portion of the first substantially vertically disposed member such that, upon connecting the back rest strap about the waist of the individual, a portion of the propliteal fossa engaging assembly contacts the propliteal fossa of an adjacently disposed knee of the individual so that, as the individual rotates the body during a swinging motion, the propliteal fossa engaging assembly enhances proper knee bend during the swinging motion.

5. The apparatus for teaching an individual proper body rotation when swinging a bat of claim 4 further comprising a knee strap connected to the propliteal fossa engaging assembly and extendable about the adjacently disposed knee for maintaining the portion of the propliteal fossa engaging assembly in contact with the propliteal fossa of the adjacently disposed knee as the individual rotates the body during a swinging motion.

6. The apparatus for teaching an individual proper body rotation when swinging a bat of claim 1 further comprising;

a second substantially vertically disposed member having a first end portion and a second end portion, the second end substantially vertically disposed member adapted to telescopically receive the first substantially vertically disposed member;

connector means for connecting the second substantially vertically disposed member to the first end portion of the first substantially vertically disposed member whereby the length of the first end portion of the first substantially vertically disposed member and the second substantially vertically disposed member can be selectively adjusted and secured in a substantially fixed, stable position on the person; and a propliteal fossa engaging member connected to the first end portion of the second substantially vertically disposed member such that, upon connecting the back rest about the waist of the individual so that the back rest is positioned on at least a portion of the lower lumbar region of the individual and connecting the rib support member substantially adjacent a rearwardly disposed arm of the individual when the individual is in a batting position, the propliteal fossa engaging member engages the propliteal fossa of the rearwardly disposed knee of the individual and cooperates with the support member of the back rest assembly and the rib support member of the rib support assembly for securing and stabilizing the elongated body member in a substantially horizontally disposed position on at least a portion of the lower lumbar region of the individual whereby at least a portion of the second end portion of the elongated body member is caused to cross over a ball striking zone when the individual has properly rotated the hips, lower body and upper body during a swing motion simulating striking of a ball passing through the ball striking zone.

7. The apparatus for teaching an individual proper body rotation when swinging a bat of claim 6 wherein the elongated body member is fabricated of a tubular polymeric material.

* * * * *